United States Patent [19]

Ho

[11] Patent Number: 4,804,051

[45] Date of Patent: Feb. 14, 1989

[54] METHOD OF PREDICTING AND CONTROLLING THE DRILLING TRAJECTORY IN DIRECTIONAL WELLS

[75] Inventor: Hwa-Shan Ho, Spring, Tex.

[73] Assignee: NL Industries, Inc., New York, N.Y.

[21] Appl. No.: 100,912

[22] Filed: Sep. 25, 1987

[51] Int. Cl.[4] ..... E21B 7/08

[52] U.S. Cl. ..... 175/26; 73/151; 175/45

[58] Field of Search ..... 175/24, 26, 45, 61, 175/62; 73/151

[56] References Cited

U.S. PATENT DOCUMENTS

| | | | |
|---|---|---|---|
| 4,015,673 | 4/1977 | Craig, Jr. et al. | 175/45 X |
| 4,303,994 | 12/1981 | Tanguy | 175/45 X |
| 4,449,595 | 5/1984 | Holbert | 175/79 |
| 4,452,075 | 6/1984 | Bockhorst et al. | 175/45 X |
| 4,662,458 | 5/1987 | Ho | 175/45 X |

OTHER PUBLICATIONS

SPE Paper No. 16658 by H-S. Ho, "Prediction of Drilling Trajectory in Directional Wells Via a New Rock--Bit Interaction Model", presented at 62nd Annual Technical Conference and Exhibition of the Society of Petroleum Engineers held in Dallas, TX, Sep. 27-30, 1987.

*Primary Examiner*—Jerome W. Massie
*Assistant Examiner*—William P. Neuder
*Attorney, Agent, or Firm*—Browning, Bushman, Zamecki & Anderson

[57] ABSTRACT

The methods disclosed herein incorporate the basic concepts and methodologies of a new general rock-bit interaction model useful in predicting and controlling drilling trajectories in directional (and deep vertical) wells. It accounts for the anisotropic drilling characteristics of both the formation and the bit. The model is developed in a 3-D geometry. Therefore, it is capable of predicting the walk tendency and the build-drop tendency of a given BHA (bottomhole assembly) under any drilling condition. The model can be used in the forward mode to predict the drilling direction; in the inverse mode to generate the rock and bit anisotrophy indices; and in the log-generation mode to generate drilling logs, such as a drilling dip log.

16 Claims, 7 Drawing Sheets

FIG. 3
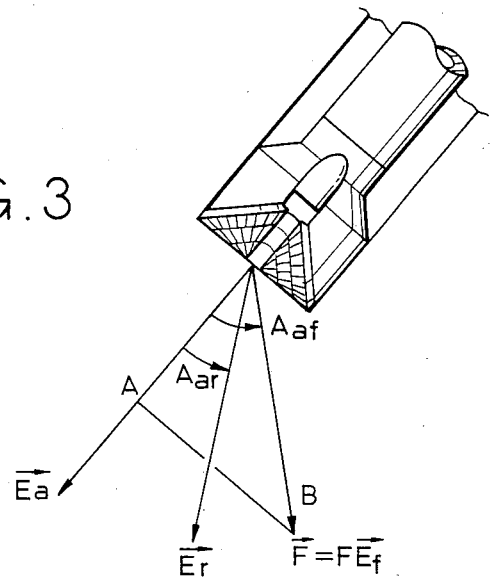
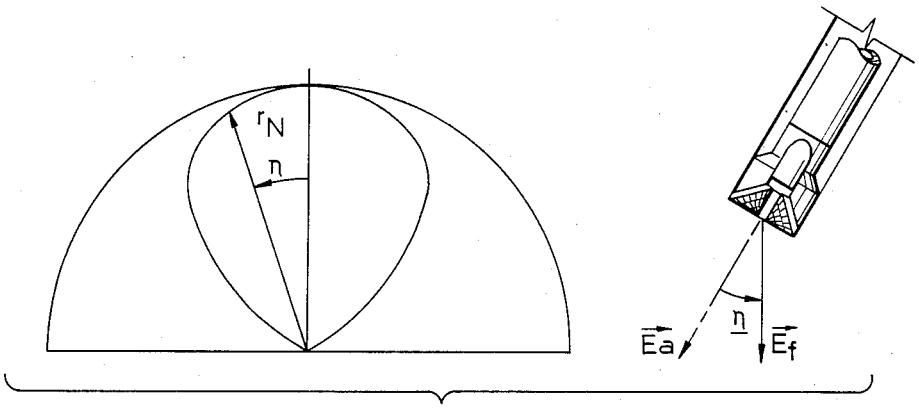
FIG. 4
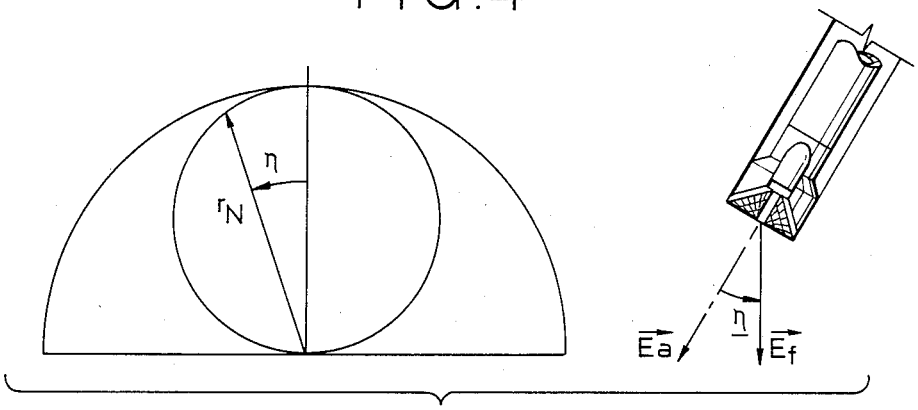
FIG. 5

METHOD OF PREDICTING AND CONTROLLING THE DRILLING TRAJECTORY IN DIRECTIONAL WELLS

BACKGROUND OF THE INVENTION

1. Field of the Invention

This invention relates, generally, to methods of predicting and controlling the drilling trajectory, in directional oil and gas wells, and specifically, to methods which provide a three-dimensional analysis of such a drilling trajectory, and the control of such trajectory, characterized by accounting for the anisotropic drilling characteristics of both the formation and the bit.

2. Description of the Prior Art

Many drillers have sometimes observed rather severe deviations. Deviation angles of up to 60° have sometimes been observed in supposedly vertical wells. Such phenomena were semi-qualitatively explained by several concepts, including the "miniature whipstock theory," which attributed them to the effect of different formation drillabilities.

A. Practices in the control of directional drilling

Improvements in our understanding of the deviation tendencies of various BHA's (Bottomhole Assembly) have come slowly. At the present, there is a heavy reliance on trial and error, though one can use any one of the following existing practices for directional control:

1. Prior experience and standard BHA types (building, dropping, or holding); This is the most common approach;
2. Bit side force as a qualitative measure of deviation tendency;
3. Resultant bit force direction as the actual drilling direction;
4. Borehole curvature that induces zero side force as the actual drilling curvature; and
5. Rock-bit interaction modeling to define the drilling direction. Additionally, one can use the following:
6. Bit axis direction as the projected drilling direction. Methods (2–6) require the use of a suitable BHA analysis program.

In method (1), a suitable type of BHA is selected for a depth region to match the planned borehole curvature, e.g., a building BHA for a building section of the borehole. Though simple, such an approach poses two problems. First, though BHA's do generally behave as expected in a straight hole, their drilling tendencies are strongly influenced by the borehole curvature and inclination, and, to a lesser extent, by the WOB (weight on bit). A "building" BHA will become a dropping assembly in a hole that builds at a sufficient curvature, and vice versa. Second, such a practice does not account for the effects of formation, borehole geometry, and operating conditions. As a result, what worked in one well or depth interval may not work in another. The consequence is that frequent correction runs are needed.

Method (2) is an improvement over method (1) in that it provides a semi-quantitative means of predicting the deviation tendency of a BHA.

Methods (3–6) provide a quantitative prediction of the actual drilling direction. They differ in how the actual drilling trajectory is defined by the known parameters, i.e., by how the "rock-bit interaction" is modeled. The degree of success of each such method lies in how well each model accounts for the relevant parameters affecting the drilling direction. Some of these methods are clearly inadequate because important parameters are neglected.

Due to diminishing world oil reserves, future exploration for fossil fuels will gradually shift to more difficult reservoirs, requiring deeper and/or offshore drilling. In either case, rig costs will be much higher than in conventional land drilling of vertical wells. Thus, more and more emphasis will be placed on directional drilling. At the same time, the increased cost of such rigs has also heightened the need to reduce drilling costs (including the tripping time while drilling) and avoid drilling troubles due to unwanted hole deviations.

Drilling deviation is the result of rock removal under the complex action of the bit. Research on the fundamental problems of rock removal and deviation involve three approaches: (1) laboratory studies, (2) stress calculations, and (3) simplified analytical ("rock-bit interaction") modeling. The first two approaches examine the actual, if simplified, rock removal and drilling deviation under given bit loads, which must include a deviation side force. Results of the tests or analyses hopefully will lead to useful (even if empirically fitted) relations that describe the deviation tendencies of bits in any particular situation.

In terms of the first approach, earlier experimental works dealt primarily with the effects of various drilling conditions on the drilling rate of various bits. Early results confirmed, at least qualitatively, the common observation that both the bit and the formation exhibit anisotropic drilling characteristics. The deviation tendency was found to depend on the bit geometry and dip angle. Early lab drilling tests, using a rock cradle that was subjected to a side force, measured the side and axial penetration rates. Using isotropic rocks, there were cnclusions that bits indeed drill anisotropically.

In terms of the second approach, plasticity theory was employed to study the limit (failure) stress state under a single bit tooth, which was idealized as a 2-D wedge or punch. Early works considered the side force generated on the bit tooth, using simplified 2-D (upper bound) analysis in plasticity. Though useful in providing some insights, these static analyses clearly do not simulate actual drilling conditions. The results are also not easily interpreted in terms of quantitative deviation trends. More recently, a large scale computer program was developed to carry out numerical analysis to study the stimulated dynamic response of PDC bits. The modeling and solution processes are extremely cumbersome and require detailed apriori knowledge of the parameters affecting the system. Most of these data are not available at present (and perhaps for a long time to come). This approach is clearly not yet practical.

Relevant parameters that affect the deviation tendency of a given BHA may be grouped into the following: (1) the BHA configuration (with or without stabilizers); (2) the borehole trajectory and geometry; (3) the operating conditions; (4) the bit; and (5) the formation being drilled. Each of these groups further contain many parameters.

Because of the large numbers of parameters involved, a more fundamental understanding can be achieved only by reducing the number of immediate parameters by rational synthesis and grouping of the contributing effects. Use of a BHA analysis program is required. The pioneering work in this respect was by Lubinski and Woods (Lubinski, A. and Woods, H. B.: "Factors Affecting the Angle of Inclination and Doglegging in Rotary Bore Holes," API Drilling & Prod. Pract., 1953, pp. 222–250; and Woods, H. B. and Lubinski, A.: "Use of Stabilizers in Controlling Hole Deviation," API Drill. & Prod. Pract., 1955, pp. 165–182.) The Lubinski model includes two elements: a 2-D BHA analysis program using a semi-analytic method to predict the side (build/drop) force on the bit in slick assemblies, and a formation anisotropy effect model to account for the commonly experienced up-dip tendency in directional drilling. The Lubinski model defines a rock anisotropy index to account for the different drillabilities parallel and perpendicular to the formation bedding plane. This model assumes bits to be isotropic. A comparison between the existing 2-D analysis and the 3-D methods described hereinafter provides an indication of a significant advance in this art.

Some existing models utilize a 2-D analysis, resulting in only a build/drop prediction. As an example, in assessing the formation effect, I have recently shown that, due to the difference in the apparent dip angle (seen in the common vertical plane) and the true dip angle (tilting away from the vertical plane), the predicted drilling direction (in the common vertical plane) will change. This will affect the result of build/drop prediction. It may also mask the bit anisotropy effect. Parallel arguments exist when one examines only the bit effect.

In a 2-D model, where the entire well bore and drill string are assumed to lie in the same vertical plane, the formation dip is seen as the apparent dip and not the true dip. These angles are equal only when the relative strike angle of the dipping plane is 90°. Otherwise, the apparent dip angle is always smaller than the true dip angle. In the extreme case when the relative strike angle is zero, the apparent dip angle is always zero, even when the true dip angle is 90°.

In a 2-D analysis, all relevant vectors are assumed to lie on the common vertical plane, which is the base plane. The formation normal vector is $\vec{E}_{da}$; the bit force is decomposed into the normal and parallel components $OB_a$ and $AB_a$. Anisotropy of the formation would cause the apparent drilling vector $\vec{E}_{ra}$ to pass through the point $C_a$. The ratio $C_aB_a/AB_a$ describes the degree of anisotropy of the formation, which is an anisotropy index. Vector $\vec{E}_{ra}$ also lies in the same base plane. Thus, no walk is predicted.

In a 3-D analysis, one uses the true formation normal vector $\vec{E}_d$, which in this particular case points above the base plane. The similar bit force components are OB and AB, and the drilling direction $\vec{E}_r$ passes through the point C. The ratio CB/AB is again the anisotropy index, which is also the same as $C_pB_p/AB_p$ (where the subscript p denotes the projection onto the base plane) due to parallel projections. We can then conclude that the line $C_aC_p$ is parallel to the vector $\vec{E}_{da}$, and therefore cannot be parallel to the vector $\vec{E}_{ra}$. In other words, the vector $\vec{E}_r$ does not project into the vector $\vec{E}_{ra}$. Additionally, the 3-D analysis also results in a walk component of $\vec{E}_r$ pointing above the base plane.

Using 3-D vector analysis, one can derive the in-plane build-drop deviation angle $A_a$ (from 2-D analysis) and $A_p$ (from projected 3-D analysis), relative to the bit force vector, as follows:

$$\tan A_a = \frac{(1 - I_r)\sin(2^*A_{fda})}{(1 - I_r)\cos(2^*A_{fda}) + (1 + I_r)}$$

-continued $$\tan A_p = \frac{(1 - I_r)\sin(2^*A_{fda})}{(1 - I_r)\cos(2^*A_{fda}) + (1 - I_r) + [2^*I_r/\sin^2 A_{dn}]}$$

$$\sin^2 A_{dn} < 1 \rightarrow A_a > A_p.$$

Here $A_{fda}$ is the angle between the bit force and the 2-D formation normal, and $A_{dn}$ is the angle between the 3-D and 2-D formation normal vectors. $A_a$ is always greater than $A_p$, $A_a$ and $A_p$ being the angles between $\vec{E}_f$ and $\vec{E}_{ra}$, and $\vec{E}_f$ and $\vec{E}_{rp}$, respectively.

It is conceivable that the true drilling direction might have a building tendency while the apparent drilling direction might show a dropping tendency, or vice versa. In anisotropic formations, there are only two exceptions to the above conclusion: when the relative strike angle $A_r$ is 90° or 0°.

1. If $A_r$ is 90°: Then the 2-D and 3-D analyses in fact coincide. A subsidiary case of this is when the true dip angle is zero. Then, the strike direction of the bedding normal is arbitrary, and can be set to 90°.

2. If $A_r$ is zero: Then formation anisotropy causes only walk deviation but no build/drop deviation.

Nevertheless, since its inception in 1953, the Lubinski model has stood for a long time as the only rationally derived rock-bit interaction model.

Recently, Brett et al developed a bit effect model. (Brett, J. F.; Gray, J. A.; Bell, R. K. and Dunbar, M. E.: "A Method of Modeling the Directional Behavior of Bottomhole Assemblies Including Those with Bent Subs and Downhole Motors," SPE/IADC conference, February 1986, Dallas. SPE Paper 14767.) Their model accounts for the anisotropic effects of the bit, but assumed the formation to be isotropic. Others have developed a bit effect model that is coupled with BHA analysis, though their model in effect assumes the drilling direction to be coincident with the bit force.

It is therefore the primary object of the present invention to provide new and improved methods for predicting the drilling trajectory in a directional well.

It is another object of the present invention, used in the inverse mode, to provide new and improved methods for determining the anisotropic rock and bit indices involved in drilling an earth borehole through an earth formation.

It is still another object of the present invention to provide new and improved methods for producing drilling dip logs.

It is yet another object of the invention to provide new and improved drilling bit wear logs and drilling lithology index logs.

It is still another object of the invention to provide methods of controlling the drilling trajectory in directional wells.

SUMMARY OF THE INVENTION

The objects of the invention are accomplished, generally, by methods which take into account both the anisotropic rock and bit indices, in conjunction with the dip of the formation, in determining the drilling trajectory in a directional well.

As an additional feature of the invention, methods are provided which produce the true dip of the formation based upon making a first determination of the anisotropy index of the formation, a second determination of the anisotropy index of the drill bit being used to drill the borehole through the formation, and a third determination of the instantaneous drilling trajectory of the drill bit.

The methods of the present invention are also used to produce an indication of the anisotropic indices of the drill bit and of the formation traversed by a well bore resulting from a drill bit based upon making a first determination of the dip of the formation and a second determination of the instantaneous drilling trajectory of the drill bit.

The invention also makes use of the anisotropic indices of both the rock and the bit to generate new and improved lithology logs and drilling bit wear logs.

The invention also provides new and improved methods for controlling the drilling trajectory in directional wells.

BRIEF DESCRIPTION OF THE DRAWINGS

These and other objects, features and advantages of the present invention will be readily apparent from reading the following detailed specification, taken in conjunction with the drawings, in which:

FIG. 3 is a schematic view, in side elevation, of a drill bit and drill string, in a directional borehole, illustrating the vectors involved with an isotropic formation;

FIG. 4 is a prior art schematic representation of a normalized drilling efficiency factor $f_N$ involved with the use of a roller cone bit in drilling a directional borehole;

FIG. 5 is a prior art schematic representation of a normalized drilling efficiency factor $r_N$ involved with the use of a PDC bit in drilling a directional borehole;

DETAILED DESCRIPTION OF THE PREFERRED EMBODIMENT

Figure 11:
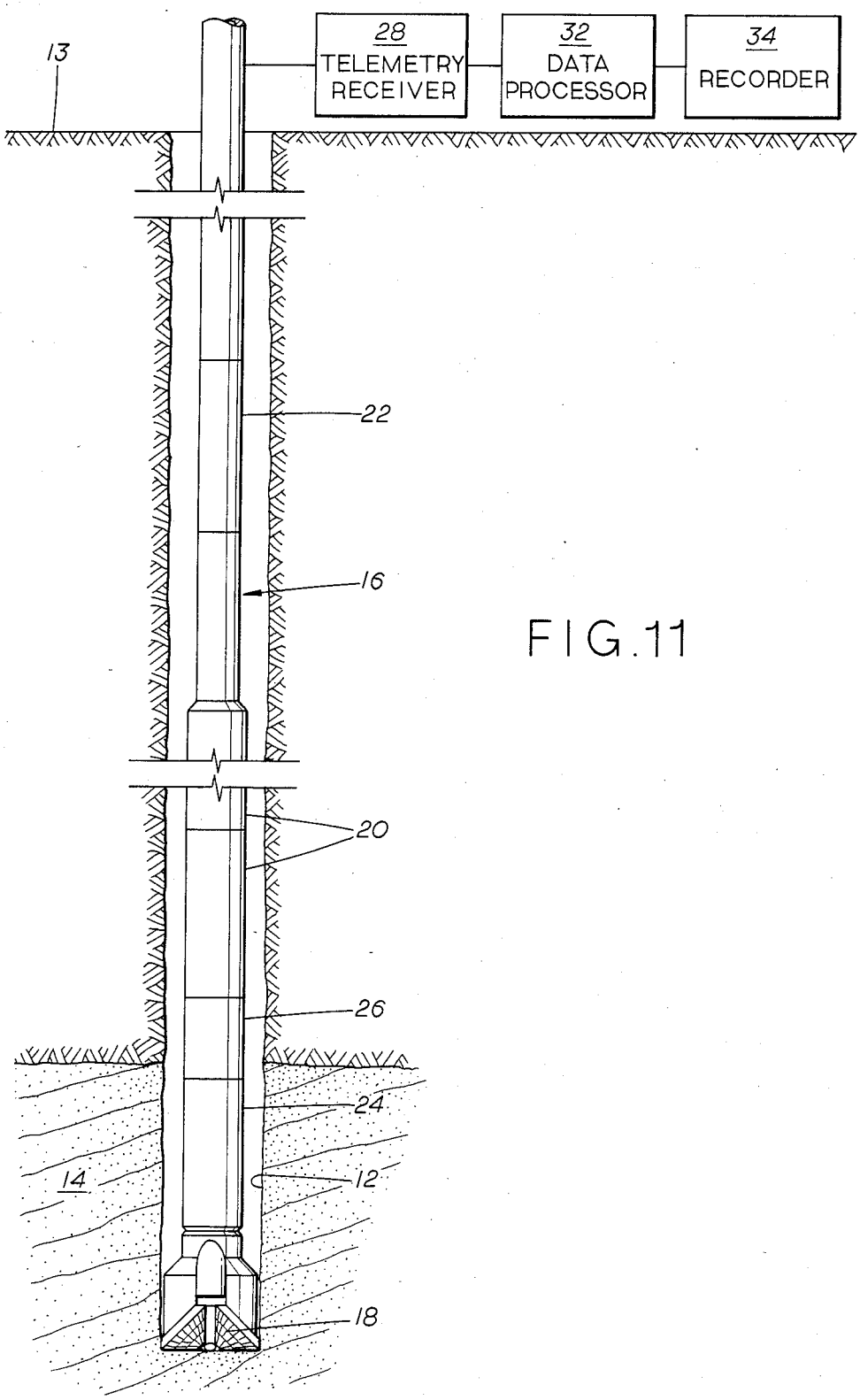
FIG. 11 illustrates, in side elevation, an MWD tool suspended in an earth borehole on a drilling string which is used to generate various signals indicative of some of the parameters used in the present invention.

Referring first to FIG. 11, a borehole 12, shown generally in the vertical axis, extends from the earth's surface 13 and penetrates the earth formations 14. The borehole is being made by a drill string 16 principally comprised of a drill bit 18, drill collars 20 and sections of drill pipe 22 extending to the earth's surface. A telemetering sub assembly 26 is used for telemetering data to the surface in a conventional manner, for example, by using positive or negative pressure pulses in the mud column in the drill pipe, and is used for telemetering data to the earth's surface indicative of various parameters measured downhole. At the earth's surface, the telemetry receiver 28 provides a means for outputting the telemetered data up the pipe string for passage of such data to a data processing unit 32, whose outputs are connected to a recorder 34.

Figure 12:
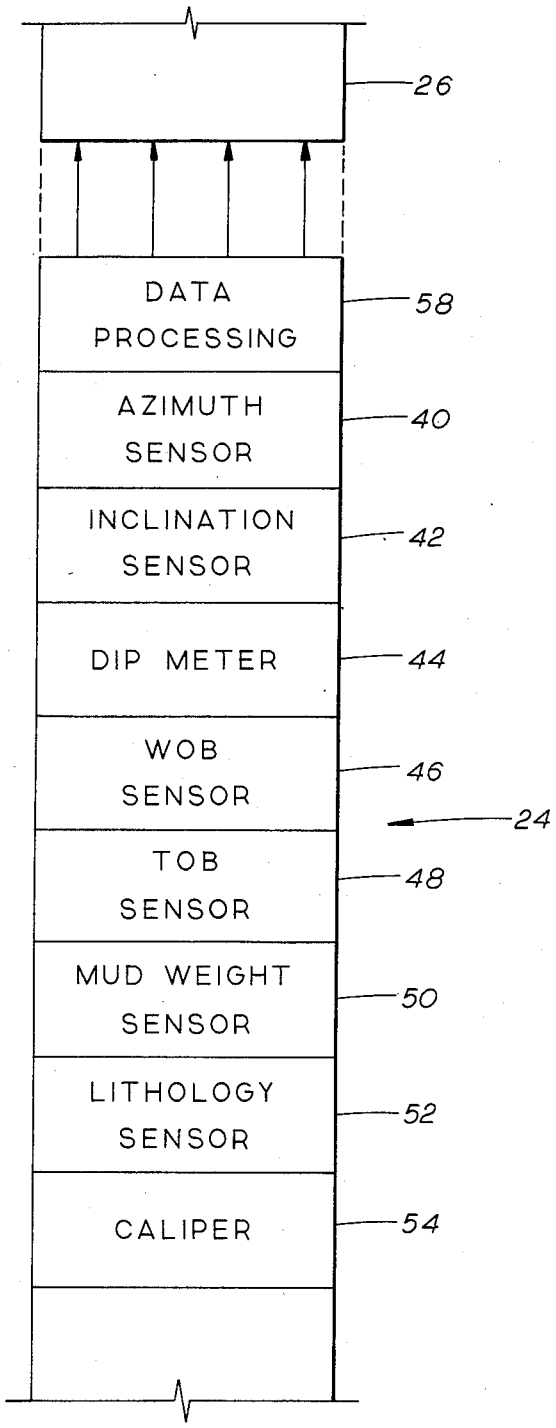
FIG. 12 illustrates in block diagram the downhole sensors and processing circuitry which are used in practicing the present invention.

Also included in the drill string is a downhole sensor and data processing unit 24, illustrated and described in greater detail in FIG. 12. Although the borehole 12 is illustrated as being vertical (non-directional) for convenience sake, the borehole is typically deviated from vertical in accordance with the present invention. However, the methods of the invention work equally well in deep vertical holes where the formation dip is other than horizontal, such as is illustrated in FIG. 11.

Referring now to FIG. 12, there is illustrated in greater detail the downhole sensor and data processing unit 24. The unit 24 includes the azimuth sensor 40 and the inclination sensor 42, each of which is conventional, for example, as illustrated and described in U.S. Pat. No. 4,163,324. The unit 24 also includes a dip meter 44 which measures, in a conventional manner, the dip of the formation as the borehole is being drilled, for example, as illustrated and described in co-pending U.S. patent application Ser. No. 824,186, filed Jan. 30, 1986. The unit 24 also includes a WOB (weight-on-bit) sensor 46, as well as a TOB (torque-on-bit) sensor 48, each of which is conventional, for example, as discussed in U.S. Pat. No. 4,662,458.

A conventional mud weight sensor 50, for example, as illustrated and described in U.S. patent application Ser. No. 734,963 filed May 16, 1985, which describes a measurement of the density of the mud, is also located in the unit 24. If desired, the mud weight can be key punched into the data processor 32 at the earth's surface, assuming the mud weight is known.

The unit 24 also includes one or more lithology sensors 52, also conventional, for example, as described and illustrated in co-pending U.S. patent application Ser. No. 654,186, filed Sept. 24, 1984. The caliper sensor 54 is also conventional, for example, as described and illustrated in U.S. Pat. No. 4,599,904. If it is desired to use the COF (coefficient of friction) in the calculations herein, that value can be key punched into the data processor 32 at the earth's surface.

It should be appreciated that the outputs of the various sensors shown in the unit 24, each of which is conventional, are processed as needed in the downhole data processing circuitry 58 and coupled into mud pulse telemetry section 26 for transmission to the earth's surface. The data can also be stored in a downhole recorder, not illustrated, for retrieval from the drill string during a tripping operation.

In practicing the process according to the present invention, one has only to use the values measured in the downhole sensor unit 24 (or key punched into the surface data processor 32), done in conjunction with the conventional BHA analysis as above described, to establish the drilling direction vector $\vec{E}_r$ hereinafter described.

Thus, for the first time in this art, through the use of known formation dip, and the use of both rock and bit anisotropy indices, there is provided herein a new and improved method for providing the instantaneous drilling trajectory of a directional well.

Inversely, through the use of known formation dip and the instantaneous drilling direction, there is provided herein a new and improved method for indicating the rock and bit anisotropy indices. By one monitoring the rock anisotropy index, one provides a lithology index log. By monitoring the bit anisotropy index, one provides a bit wear log. Thus, the anisotropy index logs provide lithology discrimination and bit wear indications.

Finally, through the use of known anisotropy indices and the instantaneous drilling direction, there is provided herein a new and improved method for generating a drilling dip log, one which will provide the true dip angle and the true dip direction.

A 3-D rock-bit interaction model according to the present invention will now be described. Referring to FIGS. 1–10, it should be appreciated that the model of FIG. 1 accounts for the simultaneous effect of rock and bit anisotropics in the drilling direction, in the following manner.

The drilling direction vector $\vec{E}_r$ is thought of as a linear function of the following three vectors: the resultant bit force $\vec{E}_f$, the bit axis $\vec{E}_a$, and the normal vector to the formation bedding $\vec{E}_d$, as follows:

$$r_N{*}\vec{E}_r = I_b{*}I_r{*}\vec{E}_f + I_r{*}(1-I_b){*}\cos A_{af}{*}\vec{E}_a + (1-I_r){*}r_N\cos A_{rd}{*}\vec{E}_d. \quad (1)$$

Here, $I_r$ and $I_b$ are the rock and bit anisotropy indices which describe the anisotropic drilling characteristics of the rock and bit; $r_N$ is the "normalized" drilling efficiency under general situations; and $A_{rd}$ is the angle between the drilling direction and the formation normal. As used herein, the following symbols have the noted definitions:

$\vec{A} = A\,\vec{E}_A$: Vector A, with magnitude A, and unit vector $\vec{E}_a$;

(A1,A2,A3): Components of vector A in (X,Y,Z) directions;

($\vec{E}1,\vec{E}2,\vec{E}3$): Unit base vectors along (X,Y,Z) directions;

$\vec{E}_a$: Unit vector along bit axis direction;

$\vec{E}_d$: Unit vector normal to formation bedding;

$\vec{E}_f$: Unit vector along the resultant bit force on formation;

$\vec{E}_r$: Unit vector along the drilling direction;

F: Resultant bit force on the formation;

$A_{af}$, etc.: Angle between $\vec{E}_a$ and $\vec{E}_f$, etc.

h: Lubinski's rock anisotropy index $= 1 - I_r$;

$I_b$: Bit anisotropy index;

$I_r$: Rock anisotropy index $= 1 - h$;

R(): Drilling rate along direction ();

r(): Drilling efficiency along direction (); $= R()/F$;

(X,Y,Z): Fixed global coordinate system, X→East, Y→North, Z→Vertical up;

$\theta$: Inclination angle;

$\phi$: Azimuth angle, measured c.w. from north.

Subscripts ():

o: Base quantities, referring to situation when both rock and bit are isotropic; or when $\vec{E}_f$, $\vec{E}_a$, $\vec{E}_d$ all coincide;

a: Bit's axial direction;

d: Formation normal direction;

f: Bit force direction;

l: Bit's lateral direction;

n: Bedding's normal direction;

p: Bedding's parallel direction;

N: "Normalized" quantity;

r: Drilling direction.

*NOTE* When two subscripts appear, that pertains to bit direction comes first.

Two degenerate cases of this model are now described.

SPECIAL CASES OF THE GENERAL MODEL

A. Isotropic Bits

This case degenerates essentially into the Lubinski model, though the latter was derived specifically only for a 2-D situation, namely the bit force, drilling direction, and the formation normal vectors all lie in the same vertical plane as the well trajectory. The Lubinski model does not account for any walk tendencies, while this isotropic bit model does. Note that the rock anisotropy index h as defined by Lubinski is related to the current definition $I_r$ by the following relation:

$$h = 1 - I_r.$$

Equation (1) can be reduced to the following simple form:

$$r_N{*}\vec{E}_r = I_r{*}\vec{E}_f + (1-I_r)\cos A_{fd}{*}\vec{E}_d$$

Figure 1:
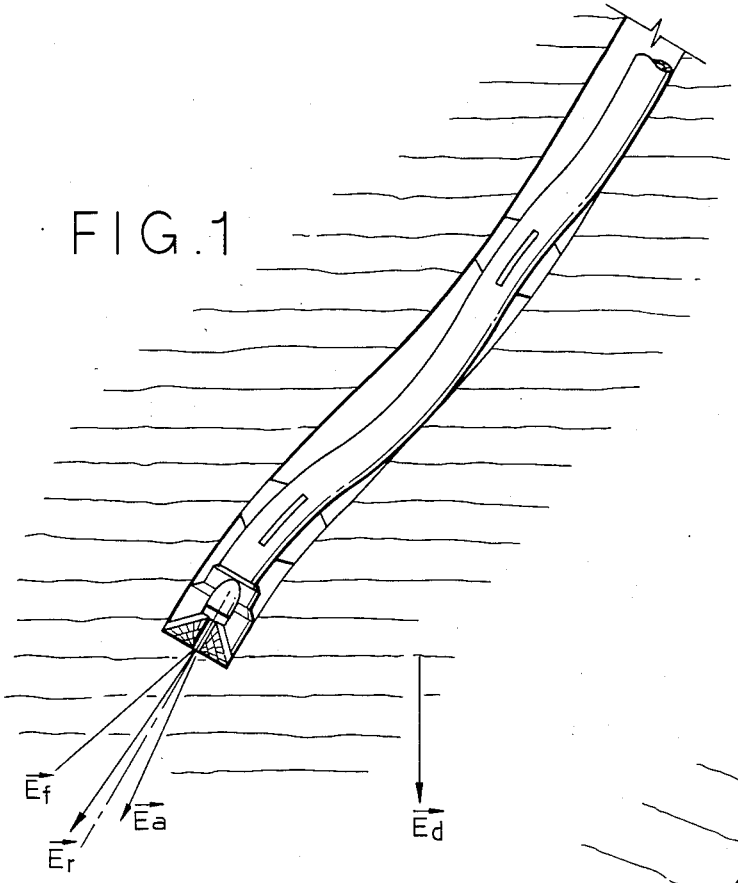
FIG. 1 is a schematic view, in side elevation, of a drill bit and drill string in a directional borehole, illustrating the vectors involving the bit force, the bit axis, the drilling direction and the formation normal.
Figure 2:
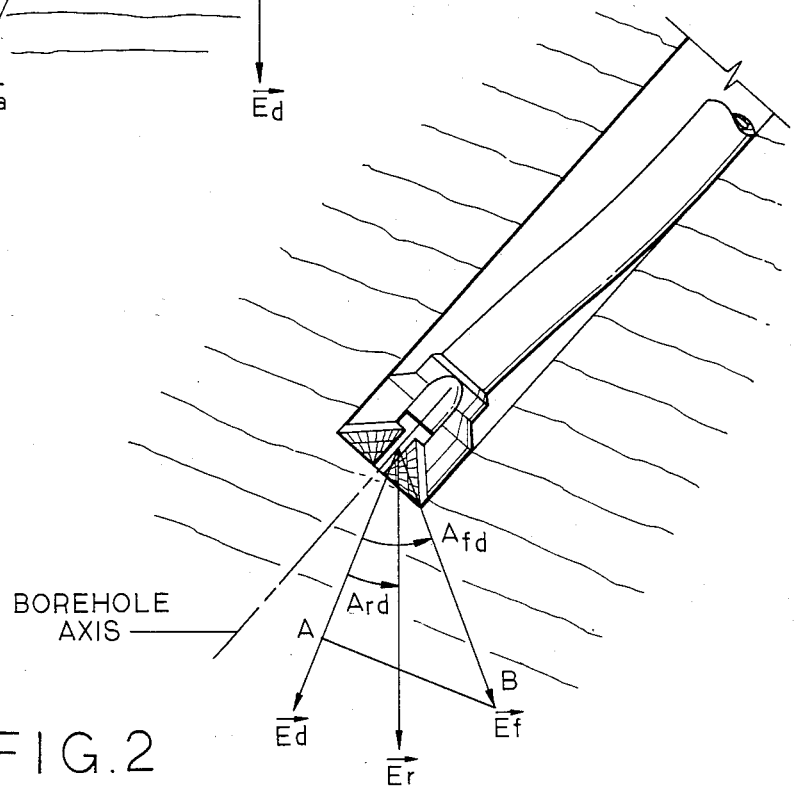
FIG. 2 is a schematic view, in side elevation, of a drill bit and drill string in a directional borehole, illustrating the vectors involved with an isotropic bit.
Figure 6:
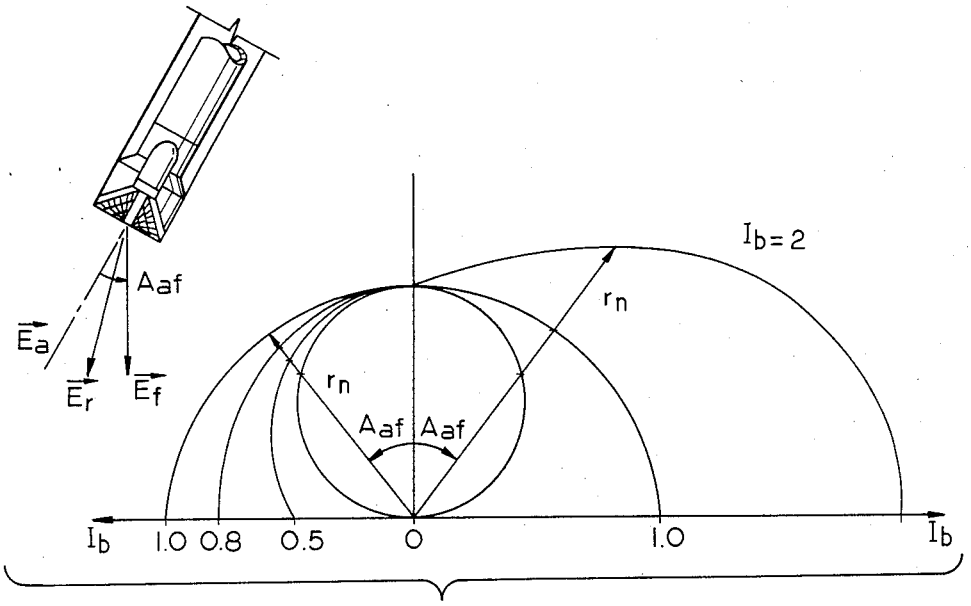
FIG. 6 is a schematic representation of a normalized drilling efficiency factor $r_N$ involved with the methods according to the present invention in predicting the drilling trajectory of a directional borehole.
Figure 10:
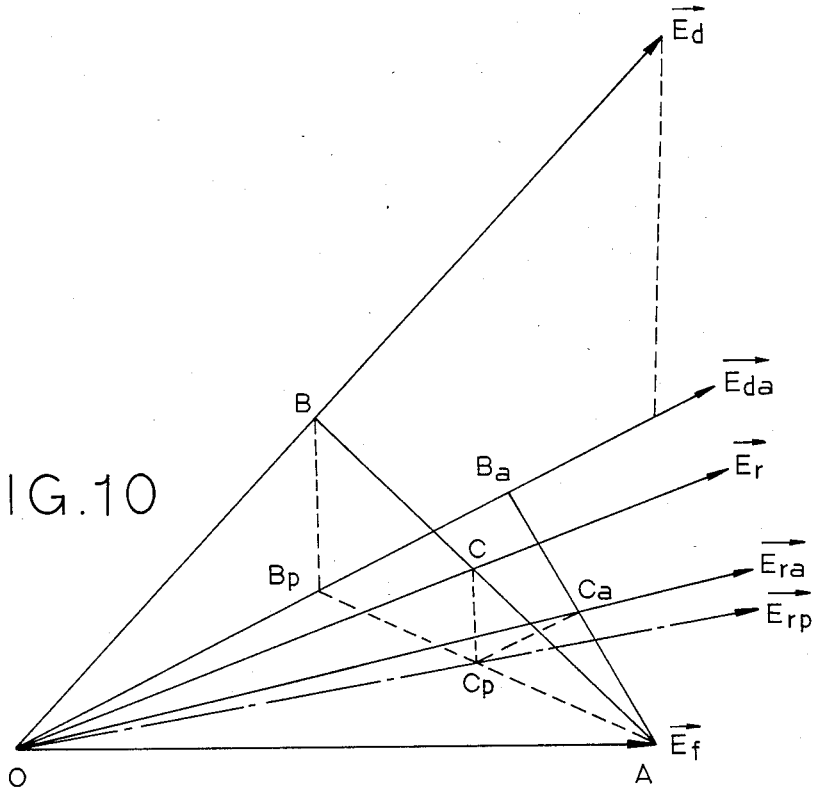
FIG. 10 schematically illustrates a comparison of the vectors involved in a 2-dimensional prediction of borehole trajectory with a 3-dimensional prediction of the borehole trajectory in accordance with the present invention.

This relation is shown in FIG. 2 in the general situation when $\vec{E}_f$ and $\vec{E}_d$ do not lie in the same vertical plane, and thus requires a 3-D spacial description.

Figure 8:
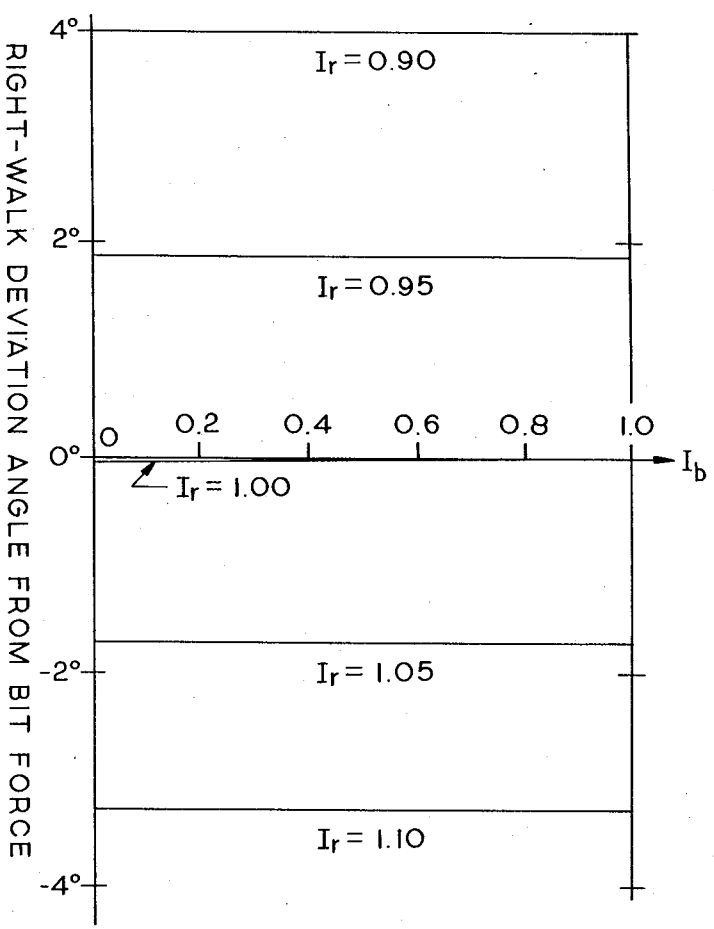
FIG. 8 is a schematic representation of the relative sensitivities of the right-walk deviation of a borehole, measured from the bit force, due to the rock anisotropy index $I_r$ and the bit anisotropy index $I_b$.

FIG. 8 shows a series of curves describing the deviation angle (measured from the bit force) as a function of the rock anisotropy index $I_r$, and $A_{fd}$, the angle between the bit force and the formation normal. In all cases, the maximum deviation occurs when $A_{fd}$ is 45°, while no deviations exist when $A_{fd}$ is zero (normal drilling) or 90° (parallel drilling).

B. Isotropic Rocks

In this case, Equation (1) reduces to the following:

$$r_N{*}\vec{E}_r = I_b{*}\vec{E}_f + (1-I_b)\cos A_{af}{*}\vec{E}_b$$

and is illustrated in FIG. 3. For "normally anisotropic" bits, $I_b$ is less than unity.

Curves similar to FIG. 8 can be used if one replaces $I_r$ and $\vec{E}_d$ by $I_b$ and $\vec{E}_a$, respectively.

First, if the bit is isotropic (FIG. 2), the model in effect reduces to the Lubinski model if the bit force, bit axis and formation normal all lie in the same vertical plane of the borehole (i.e., the 2-D case). Secondly, if the rock is isotropic (FIG. 3), the model then reduces to the Brett model for a linearly dependent drilling efficiency on the bit force.

Since this model accounts for both the bit and the formation effect, it has the potential to provide accurate predictions of drilling trajectories. Other operating parameters are considered implicitly by carrying out the BHA analysis program (to generate the bit force and the bit axis vectors). In addition, effects of RPM and hydraulics are deemed as unimportant. These affect both the lateral and forward drilling and will be cancelled out, since the anisotropy indices are ratios of two drilling efficiencies. These indices are better defined as follows:

A. Rock Anisotropy Index $I_r$

The rock anisotropy index $I_r$ is directly definable if the bit is isotropic, or if the resultant bit force is along the bit axis. Under these situations, we can define the normal and parallel drilling efficiencies, $r_n$ and $r_p$, as:

$$r_n = \frac{R_n}{F_n} = \frac{\text{drilling rate normal to bedding}}{\text{bit force normal to bedding}}$$

$$r_p = \frac{R_p}{F_p} = \frac{\text{drilling rate parallel to bedding}}{\text{bit force parallel to bedding}}$$

The rock anisotropy index is then:

$$I_r = r_p / r_n.$$

It has the following ranges:

$I_r = 0$: drilling only perpendicular to bedding;

$<1$: faster drilling along normal to bedding (up-dip tendency);

$=1$: isotropic rock, no formation effect;

$>1$: slower drilling along normal to bedding (down-dip tendency);

$\rightarrow$: drilling only parallel to bedding.

B. Bit Anisotropy Index $I_b$

If an anisotropic bit is drilling into isotropic rock, we can define the axial and lateral drilling efficiencies, $r_a$ and $r_l$, as:

$$r_a = \frac{R_a}{F_a} = \frac{\text{drilling rate in bit's axial direction}}{\text{bit force in bit's axial direction}}$$

$$r_l = \frac{R_l}{F_l} = \frac{\text{drilling rate in bit's lateral direction}}{\text{bit force in bit's lateral direction}}$$

The bit anisotropy index is then:

$$I_b = r_l / r_a.$$

It has the following ranges:

$I_b = 0$: drilling only along axial direction;

$<1$: faster drilling along bit's axial direction;

$=1$: isotropic bit, no bit effect;

$>1$: slower drilling along bit's axial direction;

$\rightarrow$: drilling only lateral to bit's axis.

The normalized drilling efficiency factor $r_N$ as defined in this model is used to define the true "base" rock penetration rate. It is dimensionless, and independent of the units of measurements used. This $r_N$ should not be confused with the normalized drilling rate sometimes used to define the D-exponent. In common practice, effects of deviation from such a "base" condition are not accounted for. In fact, $r_N$ is the additional normalization one needs to carry out in order to filter out the effects of formation dip and bit on the drilling rate.

Some have previously postulated such an $r_N$ to be less than unity, and having different patterns for roller cone bits and PDC bits (FIGS. 4 and 5), respectively. According to the present model, $r_N$ is merely described by the bit anisotropy index $I_b$ (if $I_r = 1$), and has the pattern shown in FIG. 6. The situation when $I_b > 1$ is unlikely. Interestingly, this model for the PDC bits coincides with the present model when $I_b = 0$.

APPLICATONS OF THE ROCK-BIT INTERACTION MODEL

The rock-bit interaction model can be used in the following ways, when a true 3-D BHA analysis program is used to define the bit force and bit axis:

1. Inverse Modeling: With known formation dip and instantaneous drilling direction, the model computes the rock and bit anisotropy indices. This process is required to generate the anisotropy indices for the next application.

2. Forward Modeling: With known formation dip, and rock and bit anisotropy indices, the model predicts the instantaneous drilling direction.

3. Modeling to Generate Drilling Logs: With known anisotropy indices and the instantaneous drilling direction, we can, in principle, generate a "drilling dip log." This drilling dip log will provide both the true dip angle and the true dip direction.

APPLICATION OF INVERSE MODELING

Generating Rock and Bit Anisotropy Indices

The first application of this rock-bit interaction model has been that of inverse modeling by evaluating some old well data. Only limited application has been made so far.

To this end, well data were first screened for suitability. The following information are needed:

1. Detailed information about the BHA assembly;
2. Survey data;
3. Operating conditions: WOB (weight on bit), TOB (torque on bit), and mud weight;
4. Bit type/size and bit trip (and/or daily) report; and
5. Formation dip.

In addition, a lithology log and caliper log are useful.

Data are first screened to select suitable depth points. For each depth point, a BHA analysis program was used to define the bit force and the bit axis. The actual drilling direction is defined by the tangent vector to the borehole centerline, which is obtained from interpolating the survey data (using the circular arc method). Finally, the normal to the formation bedding is provided by 3-D formation dip information. The rock-bit interaction model is then used to generate the rock and bit anisotropy indices.

Use of the dip information requires some care. Dipmeter logs, which directly provide the dip angle and dip direction, are available only for a few wells. Even then, many depth sections exhibited erratic dip data. In this case, only sections with reasonably smooth dip data were used. In other wells, only regional dip information was available. In the Gulf Coast, such regional dip data may be acceptable if no localized structures, such as salt domes, are present in the particular well (or depth region) being analyzed. Otherwise, results may not be reliable.

Another important factor that can significantly influence the data interpretation is the borehole caliber (and similarly, the stabilizer wear). A change in borehole diameter, be it overgage due to washouts or instability, or undergage due to borehole creep, can significantly influence the BHA deformation which may not be accounted for in the model, particularly if this occurs near the bit or the first couple of stabilizers. In such situations, the bit axis and the bit force directions obtained from the BHA analysis may be inaccurate.

In this case, unreasonable anisotropy indices (such as negative numbers) may be obtained. This problem points out the importance of knowing the borehole conditions accurately. The use of MWD surveys will alleviate this problem to some extent due to more timely and more frequent data collection.

Our limited results show the following average values:

$I_b=0.194$;

$I_r=0.999$.

The bits used are soft-formation roller cone bits, and are shown to be very anisotropic. The formation is only slightly anisotropic. Table 1 summarizes a portion of the data upon which the averages are based. These data are obtained in the depth interval using the same building BHA as described in the following Table 1:

TABLE 1

WELL ANALYSIS SAMPLE

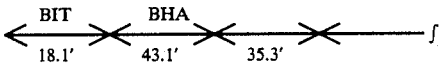

| CASE | DIP ANGLE | DIP DIRECTION | ANISOTROPY INDICES ROCK ($I_r$) | BIT ($I_b$) |
|---|---|---|---|---|
| D | 4.0 | 125.0 | 1.0009 | 0.0689 |
| E | 18.0 | 119.5 | 1.0006 | 0.3606 |
| G | 12.0 | 77.0 | 0.9964 | 0.5500 |
| H | 42.0 | 201.0 | 1.0002 | 0.1774 |
| K | 5.6 | 126.0 | 1.0008 | 0.1261 |
| M | 12.6 | 104.5 | 1.0001 | 0.0873 |
| P | 15.2 | 124.0 | 1.0006 | 0.2873 |
| Q | 12.1 | 125.0 | 1.0006 | 0.2245 |

APPLICATION OF FORWARD MODELING

Prediction of Drilling Directions

The model can also be used to predict the instantaneous drilling direction with a single analysis, or the drilling trajectory with repeated analyses. Using the average $I_r$ and $I_b$ obtained from the inverse modeling, the rock-bit interaction program recomputes the predicted survey data, using the same BHA for the same depth interval as in the example above.

Table 2 summarizes the result.

TABLE 2

EXAMPLE OF FORWARD MODELING APPLICATION

| DEPTH (FT) | PREDICTED DEV. | PREDICTED AZIM. | ACTUAL DEV. | ACTUAL AZIM. |
|---|---|---|---|---|
| 6166 | 33.97 | −88.76 | 34.00 | −88.81 |
| 6178 | 33.97 | −88.88 | 34.00 | −88.94 |
| 6218 | 34.13 | −89.00 | 34.18 | −89.00 |
| 6278 | 34.56 | −89.36 | 34.60 | −89.41 |
| 6318 | 34.57 | −89.38 | 34.61 | −89.43 |
| 6348 | 34.65 | −89.69 | 34.69 | −89.75 |
| 6372 | 34.71 | −89.95 | 34.75 | −90.00 |
| 6406 | 34.72 | −90.00 | 34.75 | −90.00 |
| 6410 | 34.72 | −90.00 | 34.75 | −90.00 |
| 6481 | 34.77 | −90.00 | 34.83 | −90.00 |

In the table, the "actual" borehole deviation and azimuth angles are computed through survey interpolation using the circular arc method. As can be seen, the model predicts the drilling directions very well. The average difference over a depth interval of about 300' between the predicted and the actual survey data are:

Deviation angle difference: 0.037°; (Variance: 0.020°).

Azimuth angle difference: 0.031°; (Variance: 0.036°).

IMPORTANCE OF BOTH THE ROCK AND BIT ANISOTROPIES

Figure 7:
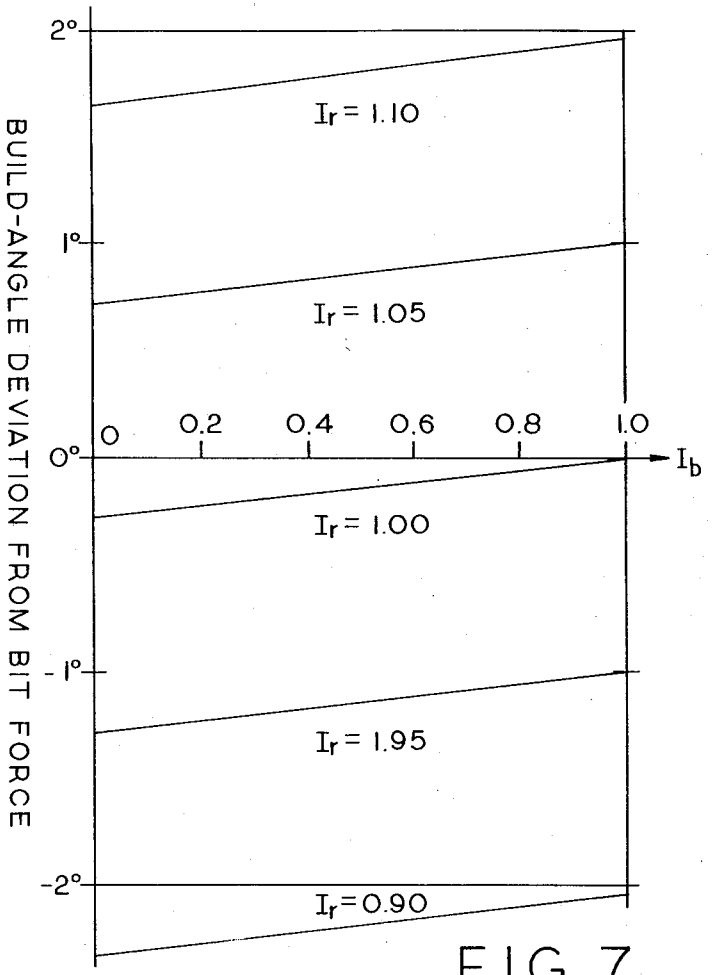
FIG. 7 is a schematic representation of the relative sensitivities of the build-angle deviation of a borehole, measured from the bit force, due to the rock anisotropy index $I_r$ and the bit anisotropy index $I_b$.
Figure 9:
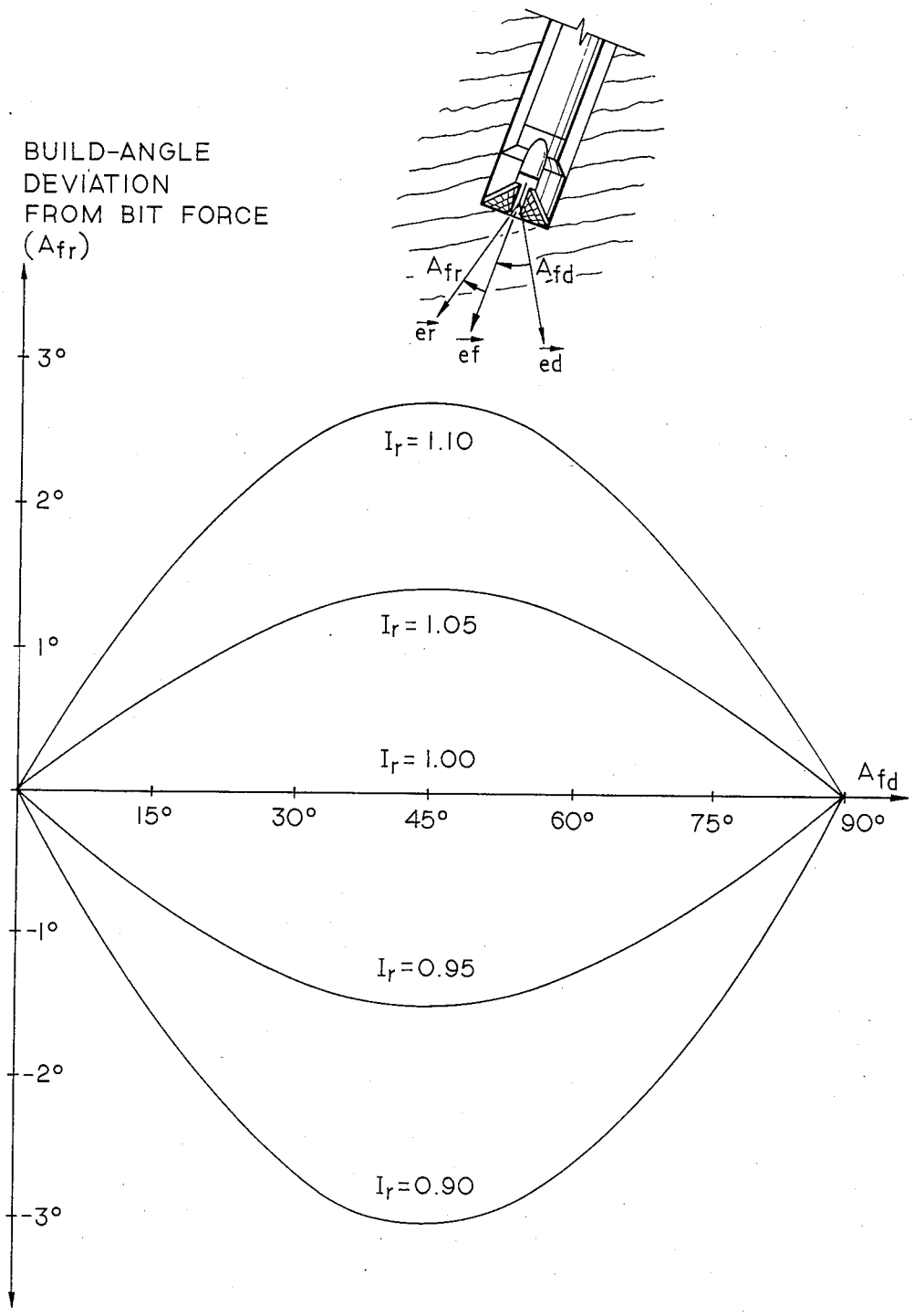
FIG. 9 schematically illustrates a family of curves describing the deviation angle, measured from the bit force as a function of the rock anisotropy index $I_r$ and $A_{fd}$, the angle between the bit force and the formation normal.

Although the rock is found to be much less anisotropic than the bit, this does not mean we can arbitrarily set it to be unity and use the degenerate model for isotropic rocks. There are two reasons: (1) The angle between the bit force and the bit axis is limited by the borehole confinement and drill string deformation, and is therefore very small (on the order of a few degrees). On the other hand, the angle between the bit force and the formation normal is quite arbitrary, and may be as large as 90°. (2) The deviation (measured from the bit force) is much more sensitive to changes in the rock anisotropy index $I_r$ than in $I_b$. FIGS. 7 and 8 illustrate these sensitivies.

Furthermore, because the angle between the bit force and the bit axis is generally very small, it is important to have a reliable BHA analysis program. Small errors is the computed bit force and bit axis vectors may cause large errors in the generated anisotropy indices.

COMPARISON OF PREDICTION METHODS

In this section, comparisons will be made between the drilling directions predicted using several different approaches. The following parameters are held constant:

WOB = 40K; TOB = 5' − K; MUD Wt. = 10 ppg;
HOLE INCLINATION = 45°; HOLE AZIMUTH = 90° at bit;

along with the same "typical" building BHA.

Three different well trajectories are examined:

(Table 3): straight well;

(Table 4): 2-D well building at 2°/100';

(Table 5): 3-D well additionally walking at 2°/100' to the right. For each situation, five prediction methods are presented:

1. $\vec{E}_r=\vec{E}_f(I_r=I_b=1)$;
2. $\vec{E}_r=\vec{E}_a$ ($I_r=1$, $I_b=0$);
3. My model ($I_r=0.99$, $I_b=0.2$);
4. Isotropic bit model ($I_b=1$, $I_r=0.99$);
5. Isotropic rock model ($I_r=1$, $I_b=0.2$); Results are independent of the formation dip, and shown only once under each table.

Tables (3–5) show results for the following dip data groups:

a. Dip angles at 0°, 20°, 40° and 60°;

For 0 dip angle, results are independent of the azimuth angle, and are shown under the table.

b. Formation normal azimuths at 90° (hole nearly perpendicular to bedding), −90° (hole nearly parallel to bedding), 0° (out-of-plane dip) and 45°.

TABLE 3

PREDICTION COMPARISONS
STRAIGHT HOLE

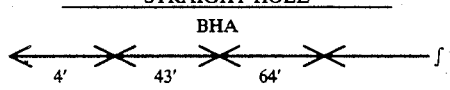

TABLE 3-continued

Conditions at the bit:

$\vec{E}_f$: = 47.259° = 90.004° (1): $\vec{E}_r = \vec{E}_f$ $\vec{E}$: = 44.992° = 90° (2): $\vec{E}_r = \vec{E}_a$ Prediction method number in parenthesis

| | | $\phi_d = 90°$ | | $\phi_d = -90°$ | | $\phi_d = 0°$ | | $\phi_d = 45°$ | |
|---|---|---|---|---|---|---|---|---|---|
| $\theta_d$ | | $\theta_r$ | $\phi_r$ | $\theta_r$ | $\phi_r$ | $\theta_r$ | $\phi_r$ | $\theta_r$ | $\phi_r$ |
| 20° | (3) | 45.223 | 90.001 | 45.227 | 90.001 | 45.191 | 89.818 | 45.207 | 89.838 |
| | (4) | 47.025 | 90.004 | 47.053 | 90.004 | 47.005 | 89.833 | 47.012 | 89.849 |
| 40° | (3) | 45.391 | 90.001 | 45.400 | 90.001 | 45.277 | 89.720 | 45.334 | 89.685 |
| | (4) | 47.187 | 90.004 | 47.231 | 90.004 | 47.090 | 89.741 | 47.134 | 89.700 |
| 60° | (3) | 45.585 | 90.001 | 45.594 | 90.001 | 45.374 | 89.754 | 45.479 | 89.612 |
| | (4) | 47.382 | 90.004 | 47.422 | 90.004 | 47.187 | 89.773 | 47.281 | 89.626 |

| | | (3) My model | (4) $I_b = 1$ | (5) $I_r = 1$ |
|---|---|---|---|---|
| $\theta_d = 0$: | $\theta_r$ | 45.158 | 46.972 | 45.446 |
| | $\phi_r$ | 90.001 | 90.004 | 90.001 |

TABLE 4

PREDICTION COMPARISONS
2-D Hole (+2°/100' CURVATURE)

Conditions at the bit:

$\vec{E}_f$: = 43.1632° = 90.001° (1): $\vec{E}_r = \vec{E}_f$ $\vec{E}$: = 44.9659° = 90° (2): $\vec{E}_r = \vec{E}_a$ Prediction method number in parenthesis

| | | $\phi_d = 90°$ | | $\phi_d = -90°$ | | $\phi_d = 0°$ | | $\phi_d = 45°$ | |
|---|---|---|---|---|---|---|---|---|---|
| $\theta_d$ | | $\theta_r$ | $\phi_r$ | $\theta_r$ | $\phi_r$ | $\theta_r$ | $\phi_r$ | $\theta_r$ | $\phi_r$ |
| 20° | (3) | 44.388 | 90.000 | 44.382 | 90.000 | 44.351 | 89.812 | 44.370 | 89.833 |
| | (4) | 42.956 | 90.001 | 42.931 | 90.001 | 42.910 | 89.803 | 42.935 | 89.827 |
| 40° | (3) | 44.559 | 90.000 | 44.551 | 90.000 | 44.436 | 89.711 | 44.499 | 89.678 |
| | (4) | 43.132 | 90.001 | 43.095 | 90.001 | 42.995 | 89.697 | 43.068 | 89.668 |
| 60° | (3) | 44.752 | 90.000 | 44.746 | 90.000 | 44.533 | 89.746 | 44.644 | 89.606 |
| | (4) | 47.322 | 90.001 | 43.292 | 90.008 | 43.091 | 89.734 | 43.211 | 89.598 |

| | | (3) My model | (4) $I_b = 1$ | (5) $I_r = 1$ |
|---|---|---|---|---|
| $\theta_d = 0$: | $\theta_r$ | 44.317 | 42.876 | 44.605 |
| | $\phi_r$ | 90.000 | 90.001 | 90.000 |

TABLE 5

PREDICTION COMPARISONS
3-D Hole (2°/100' BUILDING & °/100' WALKING RIGHT)

Conditions at the bit:

$\vec{E}_f$: = 43.066° = 86.314° (1): $\vec{E}_r = \vec{E}_f$ $\vec{E}$: = 44.966° = 89.973° (2): $\vec{E}_r = \vec{E}_a$ Prediction method number in parenthesis

| | | $\phi_d = 90°$ | | $\phi_d = -90°$ | | $\phi_d = 0°$ | | $\phi_d = 45°$ | |
|---|---|---|---|---|---|---|---|---|---|
| $\theta_d$ | | $\theta_r$ | $\phi_r$ | $\theta_r$ | $\phi_r$ | $\theta_r$ | $\phi_r$ | $\theta_r$ | $\phi_r$ |
| 20° | (3) | 44.359 | 89.264 | 44.352 | 89.259 | 44.322 | 89.071 | 44.342 | 89.096 |
| | (4) | 42.959 | 86.331 | 42.832 | 86.305 | 42.813 | 86.111 | 42.841 | 86.149 |
| 40° | (3) | 44.531 | 89.268 | 44.522 | 89.260 | 44.408 | 89.968 | 44.472 | 88.941 |
| | (4) | 43.035 | 86.348 | 42.996 | 86.309 | 42.899 | 85.994 | 42.979 | 85.996 |
| 60° | (3) | 44.723 | 89.270 | 44.717 | 89.263 | 44.505 | 89.001 | 44.618 | 88.869 |
| | (4) | 43.225 | 86.358 | 43.192 | 86.324 | 42.996 | 86.018 | 43.129 | 85.924 |

| | | (3) My model | (4) $I_b = 1$ | (5) $I_r = 1$ |
|---|---|---|---|---|
| $\theta_d = 0$: | $\theta_r$ | 45.158 | 46.972 | 45.446 |
| | $\phi_r$ | 90.001 | 90.004 | 90.001 |

For isotropic rocks ($I_r = 1$), results are independent of dip variation. Therefore, only one case is shown in each of the tables. In the tables, the prediction method number is shown in parenthesis.

A deviation angle from hole axis of 0.3° will be mild, while 1.0° will be strong. Since this deviation angle is the instantaneous drilling deviation angle, it is not directly translated into the more common notion of change in hole curvature. To compute that, one needs to carry out successive calculations after each finite drilling distance, and then take the average curvature. This incremental approach is probably more realistic than the common notion, as it more closely duplicates the actual drilling process.

In Table 3, we see the bit force to be strongly building, while the bit axis is actually slightly dropping. As a result, method (2) would predict a very mild dropping trend, while all other methods predict mild to strong building trends. As expected, methods 3 and 4 predict similar left-walking, but differ very significantly in the build trend prediction.

In Table 4, the inherent hole curvature causes both the bit force and the bit axis to be dropping. This is due to the stiffness of the BHA, as pointed out previously. Therefore, all methods predict a dropping trend. Methods 3 and 4 also predict a left-walking trend. The severity of the dropping trend varies according to the methods. Note that, once drilling is allowed to proceed according to the predicted direction (dropping), the hole curvature is reduced, and therefore the inherent dropping tendency of the BHA will also be reduced. This will then change the future drilling direction to be either less dropping, or even return to slightly building. Such repetitive computations and case studies will be presented in later papers.

In Table 5, the right-walking hole curvature further causes left-walking trends in both the bit force and the bit axis. As a result, all methods now predict moderate to strong left-walking tendencies.

In both 2- and 3-D holes, we see that using the bit force (method (2)) as the predictor of drilling direction actually provides the greatest scatter. Most current practices are in fact based on this method.

It is generally agreed that a comprehensive drilling analysis program will include the following elements:

(1) a BHA (bottom hole assembly) analysis;

(2) a predictive model which relates the drilling direction to the bit used, the drilling conditions, the borehole geometry, and the formation drilled; and (3) a drill ahead/post analysis feature. Many BHA analysis programs have been developed. In my paper to be presented at the 62nd Annual Technical Conference and Exhibition of the Society of Petroleum Engineers to be held in Dallas, Tex., on Sept. 27–30, 1987, such paper being incorporated herein by reference, I identify a number of such programs.

However, a good BHA analysis program can serve the following functions:

(a) Quantitatively describe the deformation of the BHA, including the total bit force (build/drop and walk) components, and the bit tilt direction. These data, alone and/or in conjunction with a rock-bit interaction model, can be used to infer the build/drop and, for a 3-D program, the walk trend(s).

(b) Determine the locations and magnitudes of contact forces between the BHA and the borehole wall. These data are useful in estimating the wear rates of tool joints, stabilizers, casings, and boreholes. They are also useful in torque and drag computations (See (e) below).

(c) Compute the stresses in the BHA, which can be used to locate the critically stressed sections. This is particularly valuable for the expensive downhole tool subs.

(d) Calculate the difference between the survey sub axial direction and the borehole centerline direction, leading to a correction of MWD survey data.

(e) Form a part of a torque-drag model program to enable more accurate computation of the torque and drag in a directional and deep vertical well. Such models are useful in optimum well planning; in the designs of surface equipment, drill string and casing; and in the diagnosis and avoidance of drilling troubles.

The existing BHA programs use different approaches (semi-analytic method, finite-element method, or finite-difference method), and contain different features. Some of them are 2-D analysis programs.

The usefulness of a BHA analysis program depends on its inherent features and capabilities. Selection of a BHA analysis program should be made by matching the user's needs with program features. Other considerations include the quality and rigor in the methodology used in the program, user-friendliness, and the speed of computation, which becomes critical if the program is to be used at the rig site for "real-time" operations.

A drill-ahead program allows repeated calculations at different projected bit locations, thus leading to a predicted drilling trajectory. As a companion feature, post drilling analysis allows for a more detailed comparison of actual vs. predicted drilling trajectories, and can provide much other useful information about the well in the form of generated "drilling logs." These, for example, will include drilling formation dip logs; drilling lithology index logs, using $I_r$; and drilling bit wear index logs, using $I_b$.

It should be appreciated that the methods described hereinbefore to predict the drilling trajectory can be used to actually control the trajectory. Based upon data built up from near, off-set wells having the same or similar dips in the formation, and the same or similar rock and bit anisotropic indices, one can design the BHA to control the trajectory. For example, the drill bit, the stabilizers, the subs (bent or non-bent) and other aspects of the BHA can be selected to take advantage of the knowledge of the dip and the anisotropic indices to thus control the drilling trajectory. This allows the drilling of the well first "on paper," followed by the actual drilling.

What is claimed is:

1. A method for predicting the drilling trajectory of a drill bit in a directional well through an earth formation, comprising the steps of:

a. making a first determination of the dip of the said formation;

b. making a second determination of the anisotropy index of the said formation;

c. making a third determination of the anisotropy index of the said drill bit; and d. combining said first, second and third determinations to produce the instantaneous drilling trajectory of said drill bit.

2. The method according to claim 1 wherein said combining steps are done in accordance with the relationship $$r_N*\vec{E}_r=I_b*I_r*\vec{E}_f+I_r*(1-I_b)*\cos A_{af}*\vec{E}_a+(1-I_r)*r_N\cos A_{rd}*\vec{E}_d,$$

wherein:

$r_N$=normalized drilling efficiency under generalized situations;

$\vec{E}_r$=unit vector along drilling direction;

$I_b$=bit anisotropy index;

$I_r$=rock anisotropy index;

$\vec{E}_f$=unit vector along the resultant bit force on the formation;

$A_{bf}$=angle between the drilling direction and formation normal;
$\vec{E}_a$=unit vector along bit axis direction;
$A_{rd}$=angle between the drilling direction and the formation normal;
$A_{af}$=angle between $\vec{E}_a$ and $\vec{E}_f$;
$\vec{E}_d$=unit vector normal to formation bedding.

3. The method according to claim 1 wherein the steps are carried out repetitively at successive drilling depths to arrive at the predicted drilling trajectory.

4. The method according to claim 3 wherein said combining steps are done in accordance with the relationship $$r_N*\vec{E}_r=I_b*I_r*\vec{E}_f+I_r*(1-I_b)*\cos A_{af}*\vec{E}_a+(1-I_r)*r_N\cos A_{rd}*\vec{E}_d,$$

wherein:
$r_N$=normalized drilling efficiency under generalized situations;
$\vec{E}_r$=unit vector along drilling direction;
$I_b$=bit anisotroppy index;
$I_r$=rock anisotrpy index;
$\vec{E}_f$=unit vector along the resultant bit force on the formation;
$A_{bf}$=angle between the drilling direction and formation normal;
$\vec{E}_a$=unit vector along bit axis direction;
$A_{rd}$=angle between the drilling direction and the formation normal;
$A_{af}$=angle between $\vec{E}_a$ and $\vec{E}_f$;
$\vec{E}_d$=unit vector normal to formation bedding.

5. A method for producing the dip of a formation traversed by a well bore resulting from a drill bit drilling through said formation, comprising the steps of:
a. making a first determination of the anisotropy index of the said formation;
b. making a second determination of the anisotropy index of said drill bit;
c. making a third determination of the instantaneous drilling trajectory of said drill bit; and
d. combining said first, second and third determinations to produce the dip of said formation.

6. The method according to claim 5 wherein said combining steps are done in accordance with the relationship $$r_N*\vec{E}_r=I_b*I_r*\vec{E}_f+I_r*(1-I_b)*\cos A_{af}*\vec{E}_a+(1-I_r)*r_N\cos A_{rd}*\vec{E}_d,$$

wherein:
$r_N$=normalized drilling efficiency under generalized situations;
$\vec{E}_r$=unit vector along drilling direction;
$I_b$=bit anisotropy index;
$I_r$=rock anisotropy index;
$\vec{E}_f$=unit vector along the resultant bit force on the formation;
$A_{bf}$=angle between the drilling direction and formation normal;
$\vec{E}_a$=unit vector along bit axis direction;
$A_{rd}$=angle between the drilling direction and the formation normal;
$A_{af}$=angle between $\vec{E}_a$ and $\vec{E}_f$;
$\vec{E}_d$=unit vector normal to formation bedding.

7. The method according to claim 5 wherein the steps are carried out repetitively at successive drilling depths to arrive at the dip of the formation.

8. The method according to claim 7 wherein said combining steps are done in accordance with the relationship $$r_N*\vec{E}_r=I_b*I_r*\vec{E}_f+I_r*(1-I_b)*\cos A_{af}*\vec{E}_a+(1-I_r)*r_N\cos A_{rd}*\vec{E}_d,$$

wherein:
$r_N$=normalized drilling efficiency under generalized situations;
$\vec{E}_r$=unit vector along drilling direction;
$I_b$=bit anisotropy index;
$I_r$=rock anisotropy index;
$\vec{E}_f$=unit vector along the resultant bit force on the formation;
$A_{bf}$=angle between the drilling direction and formation normal;
$\vec{E}_a$=unit vector along bit axis direction;
$A_{rd}$=angle between the drilling direction and the formation normal;
$A_{af}$=angle between $\vec{E}_a$ and $\vec{E}_f$;
$\vec{E}_d$=unit vector normal to formation bedding.

9. A method for producing an indication of the anisotropy indices of the drill bit and of the formation traversed by a well bore resulting from a drill bit drilling through said formation, comprising the steps of:
a. making a first determination of the dip of the same formation;
b. making a second determination of the instantaneous drilling trajectory of said drill bit; and
c. combining said first and second determinations to produce indications of the said anisotropy index of the said drill bit and the anisotropy index of the said formation.

10. The method according to either of claim 9 wherein said combining steps are done in accordance with the relationship $$r_N*\vec{E}_r=I_b*I_r*\vec{E}_f+I_r*(1-I_b)*\cos A_{af}*\vec{E}_a*E_a+(1-I_r)*r_n\cos A_{rd}*\vec{E}_d,$$

wherein:
$r_N$=normalized drilling efficiency under generalized situations;
$\vec{E}_r$=unit vector along drilling direction;
$I_b$=bit anisotropy index;
$I_r$=rock anisotropy index;
$\vec{E}_f$=unit vector along the resultant bit force on the formation;
$A_{bf}$=angle between the drilling direction and formation normal;
$\vec{E}_a$=unit vector along bit axis direction;
$A_{rd}$=angle between the drilling direction and the formation normal;
$A_{af}$=angle between $\vec{E}_a$ and $\vec{E}_f$;
$\vec{E}_d$=unit vector normal to formation bedding.

11. The method according to claim 9 wherein the steps are carried out repetitively at successive drilling depths to arrive at the indication of the said anisotropy indices.

12. The method according to claim 11 wherein said combining steps are done in accordance with the relationship $$r_N*\vec{E}_r=I_b*I_r*\vec{E}_f+I_r*(1-I_b)*\cos A_{af}*\vec{E}_a+(1-I_r)*r_N\cos A_{rd}*\vec{E}_d,$$

wherein:

$r_N$=normalized drilling efficiency under generalized situations;

$\vec{E}_r$=unit vector along drilling direction;

$I_b$=bit anisotropy index;

$I_r$=rock anisotropy index;

$\vec{E}_f$=unit vector along the resultant bit force on the formation;

$A_{bf}$=angle between the drilling direction and formation normal;

$\vec{E}_a$=unit vector along bit axis direction;

$A_{rd}$=angle between the drilling direction and the formation normal;

$A_{af}$=angle between $\vec{E}_a$ and $\vec{E}_f$;

$\vec{E}_d$=unit vector normal to formation bedding.

13. The method according to claim 11 characterized further by the step of using the said anisotropy index of the drill bit to generate a drilling bit wear log.

14. The method according to claim 11 characterized further by the step of using the anisotropy index of the formation to generate a drilling lithology index log.

15. A method for controlling the drilling trajectory of a drill bit included in a drill string having a bottomhole assembly in a directional well through an earth formation, comprising the steps of:

a. making a first determination of the dip of the said formation;

b. making a second determination of the anisotropy index of the said formation;

c. making a third determination of the anisotropy index of the said drill bit; and d. combining said first, second and third determinations to determine the make-up of the bottomhole assembly, to thereby control the drilling trajectory of said drill bit.

16. The method according to claim 15 wherein said combination step is done in accordance with the relationship $$r_N*\vec{E}_r=I_b*I_r*\vec{E}_f+I_r*(1-I_b)*\cos A_{af}*\vec{E}_a+(1-I_r)*r_N\cos A_{rd}*\vec{E}_d,$$ wherein:

$r_N$=normalized drilling efficiency under generalized situations;

$\vec{E}_r$=unit vector along drilling direction;

$I_b$=bit anisotropy index;

$I_r$=rock anisotropy index;

$\vec{E}_f$=unit vector along the resultant bit force on the formation;

$A_{bf}$=angle between the drilling direction and formation normal;

$\vec{E}_a$=unit vector along bit axis direction;

$A_{rd}$=angle between the drilling direction and the formation normal;

$A_{af}$=angle between $\vec{E}_a$ and $\vec{E}_f$;

$\vec{E}_d$=unit vector normal to formation bedding.

* * * * *

UNITED STATES PATENT AND TRADEMARK OFFICE

CERTIFICATE OF CORRECTION

PATENT NO. : 4,804,051

DATED : February 14, 1989

INVENTOR(S) : Hwa-Shan Ho

It is certified that error appears in the above-identified patent and that said Letters Patent is hereby corrected as shown below:

Column 17, Line 22, delete "anisotroppy" and insert therefor --anisotropy--.

Column 17, Line 23, delete "anisotrpy" and insert therefor --anisotropy--.

Column 18, delete Line 40 in its entirety and insert therefor --$A_{af}*E_a*+(1-I_r)*r_N\cos A_{rd}*E_d$,--

Signed and Sealed this

Twenty-fourth Day of October, 1989

*Attest:*

DONALD J. QUIGG

*Attesting Officer*

*Commissioner of Patents and Trademarks*